United States Patent [19]

Yamanoi

[11] 4,199,095

[45] Apr. 22, 1980

[54] STAPLING MEANS

[75] Inventor: Noboru Yamanoi, Narashino, Japan

[73] Assignee: Maruzen Kabushiki Kaisha, Tokyo, Japan

[21] Appl. No.: 969,016

[22] Filed: Dec. 13, 1978

[30] Foreign Application Priority Data

| | | | |
|---|---|---|---|
| Dec. 15, 1977 | [JP] | Japan | 52/151068 |
| Dec. 15, 1977 | [JP] | Japan | 52/151069 |
| Jun. 30, 1978 | [JP] | Japan | 53/90556[U] |

[51] Int. Cl.[2] ..... B25C 5/02

[52] U.S. Cl. ..... 227/125; 227/120; 227/129; 227/155

[58] Field of Search ..... 227/120, 125, 129, 135, 227/155

[56] References Cited

U.S. PATENT DOCUMENTS

| | | | |
|---|---|---|---|
| 1,065,680 | 6/1913 | Grissinger | 227/155 |
| 1,938,386 | 12/1933 | Hicks | 227/129 |
| 3,680,759 | 8/1972 | Tyszkiewicz | 227/120 |

FOREIGN PATENT DOCUMENTS

| | | | |
|---|---|---|---|
| 1011398 | 7/1957 | Fed. Rep. of Germany | 227/155 |
| 1416324 | 9/1965 | France | 227/120 |
| 953047 | 3/1964 | United Kingdom | 227/120 |

*Primary Examiner*—John McQuade
*Attorney, Agent, or Firm*—James E. Nilles

[57] ABSTRACT

An electric stapler comprising: a staple bending table; a main arm having a staple push-out blade at the forward edge thereof and supported turnably at the rear edge thereof; a sub-arm turnably supported by said main arm at a position other than the support point for rotation of said main arm; and a drive mechanism connected turnably to said sub-arm at a position more forward with respect to the support point of said sub-arm and imparting a rotary force in one direction to said sub-arm.

3 Claims, 19 Drawing Figures

STAPLING MEANS

This invention relates to an electric stapler for binding leaves of paper by means of staples.

In this kind of electric stapler in general, the elevation of a staple push-out blade with respect to a staple bending table is kept constant in accordance with an angle of rotation of a main arm which causes the staple push-out blade to elevate. If the thickness of the leaves of paper to be inserted between the staple bending table and the staple push-out blade is great, then, the main arm can not rotate any more. Nonetheless, a rotary force is imparted to the main arm with such a consequence that an excessive mechanical load is sometimes applied to the main arm and causes it to break. It is therefore a customary practice to manually set the gap between the staple bending table and the staple push-out blade to match the thickness of the leaves of paper or to take other complicated measures.

Accordingly, the present invention connects a sub-arm to the main arm for elevating the staple push-out blade in such a manner that a rotary force is imparted to the main arm via this sub-arm and when a load exceeding a predetermined level is applied to the main arm, the sub-arm rotates independently of the main arm and bears the load acting on the main arm, thereby preventing damage to the main arm and enabling performance of the binding work irrespective of the thickness of the leaves of paper to be bound.

When the leaves of paper are bound by a staple, the binding work is completed under such a state where both legs of the staple are curved and protrude outward on the back of the lowermost paper. The curved section consisting of these curved legs is an obstacle and renders various problems for handling of documents so bound. For example, when the bound documents are piled, the portion or portions of the curved legs of the staples become far bulkier than other portions. This is especially troublesome when the number of the documents increases and becomes a serious problem not only in handling but also in filing of the documents. If the length of legs of the staple is not sufficient in comparison with the thickness of the documents, the legs are not bent sufficiently, remain upright and sometimes stab a finger or impair the surface of other paper.

It is therefore an object of the present invention to provide an electric stapler which presses and makes flat both legs of a staple along the back of the paper when used in conjunction with the work of binding leaves of paper in order to ensure easy handling and filing of the document after binding.

In the conventional stapler, feed of staples is made in such a manner that one or two series of staples are incorporated inside a staple guide passage and are pushed forward by a staple press member into the binding section. If the staples to be pushed forward by the staple press members are completely used up, it is necessary to stop temporarily the operation of the stapler and to pull back the press member in order to supplement the staples. The time required for supplementing the staples becomes a serious problem especially when the frequency of usage of the stapler is high.

It is therefore another object of the present invention provide an electric stapler in which a cassette case incorporating therein a number of series of staples is set in the staple guide passage so as to feed continuously the staples from this cassette case.

It is still another object of the present invention to provide an electric stapler which enables one to continuously feed the staples to the binding section, to bind leaves of paper by means of the staple thus fed taking into account the thickness of the document and to make flat both legs of the staple which are bent at the time of binding simultaneously with the binding work.

These and other objects as well as features of the present invention will be made apparent from the following detailed description taken in conjunction with the accompanying drawings in which.

Figure 8A:
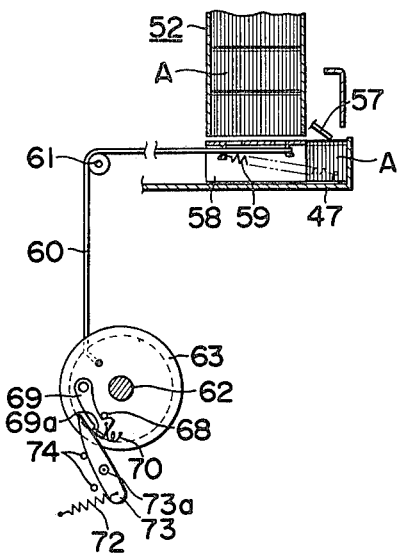
Figure 8C:
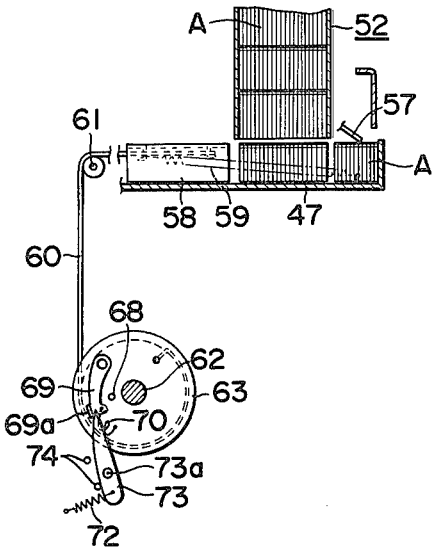
Figure 8B:
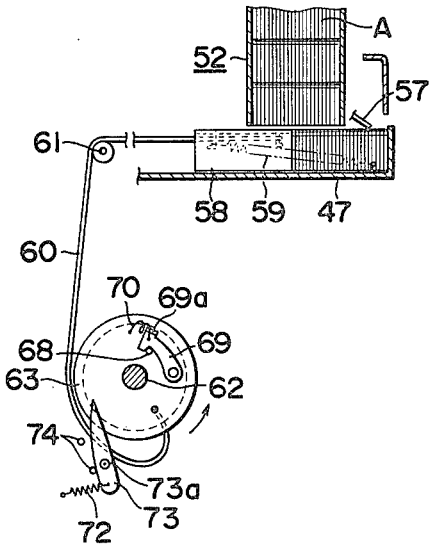
Figure 9:
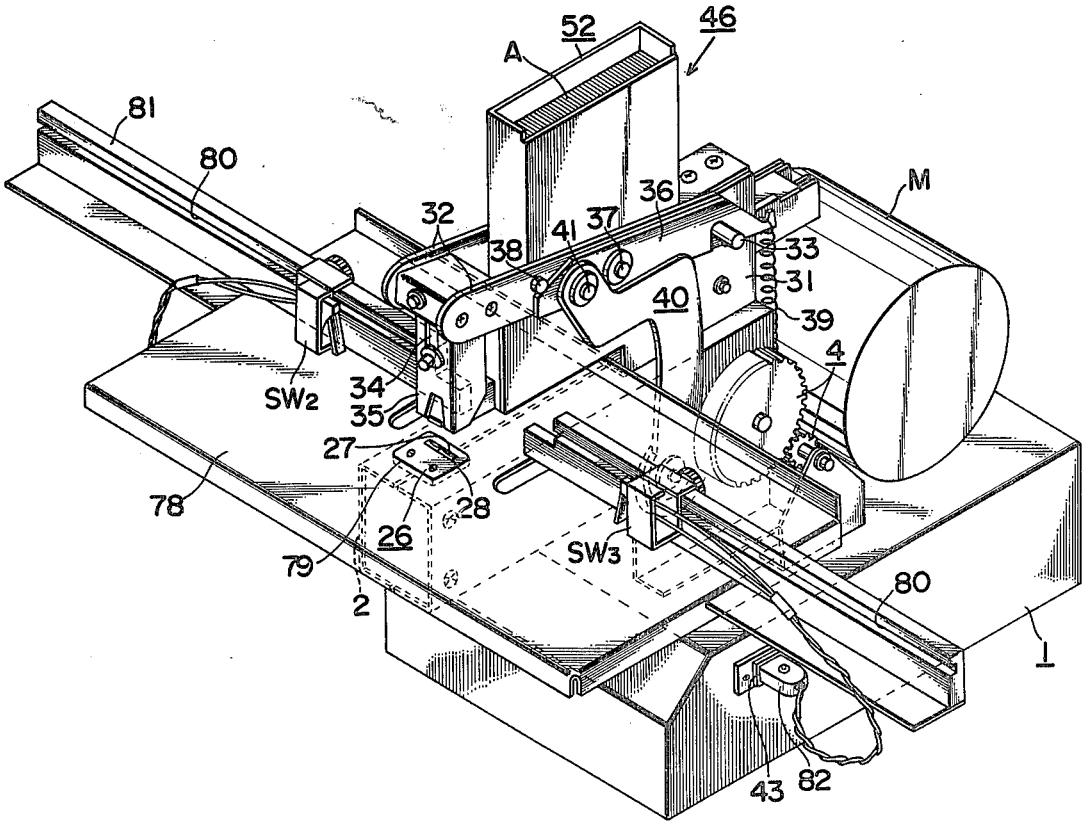
Figure 10:
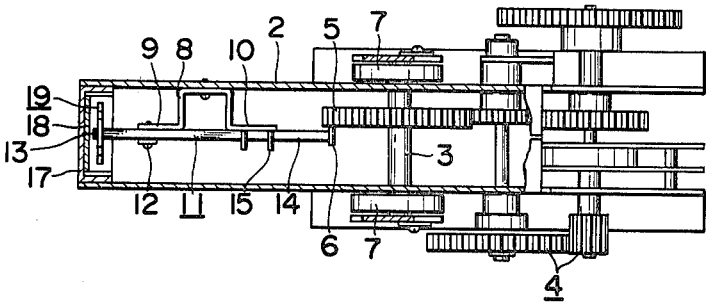
Figure 11:
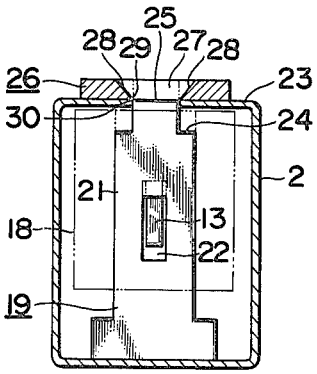
Figure 12:
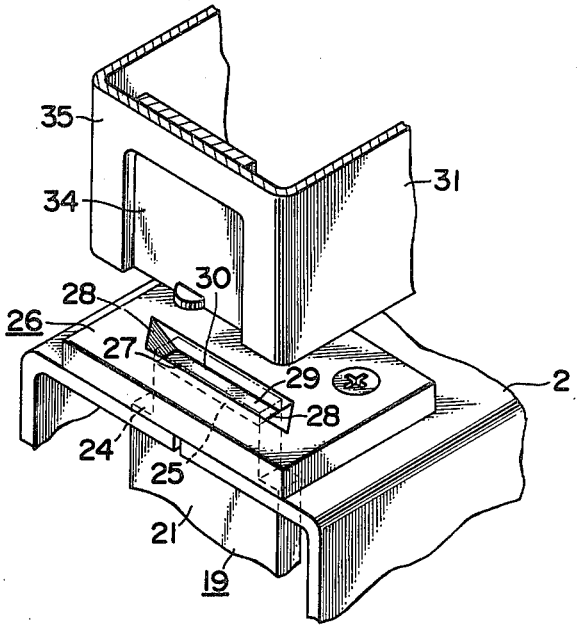
Figure 13A:
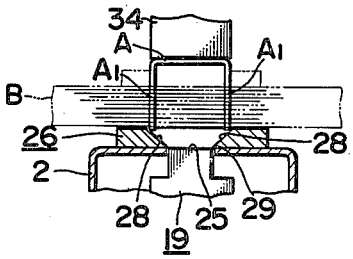
Figure 13B:
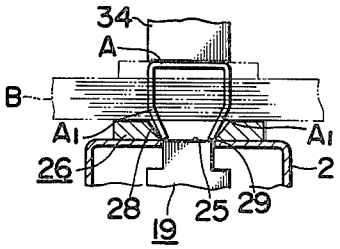
Figure 13C:
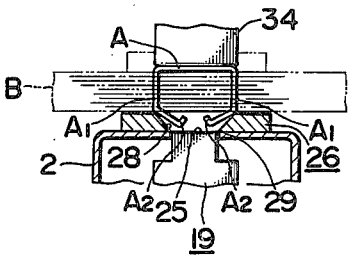
Figure 13D:
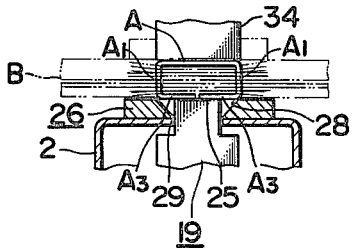
Figure 14:
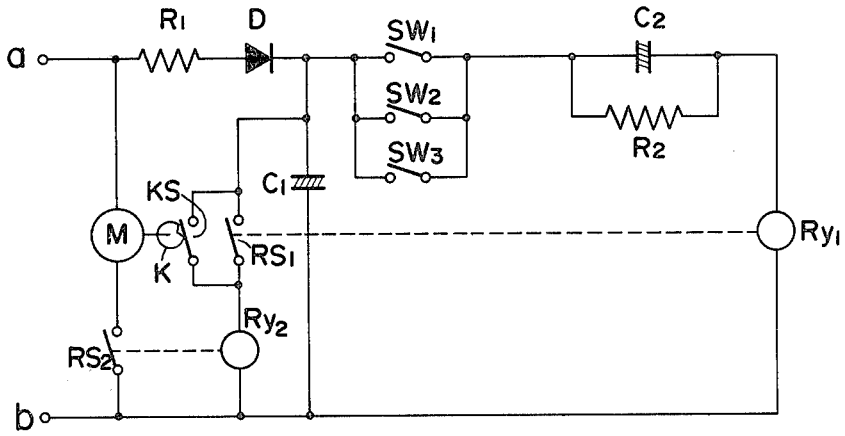

FIGS. 8(*a*), 8(*b*) and 8(*c*) are schematic views each showing the action of the staple feeder device;

FIG. 9 is a perspective view showing the fitting condition of a support table;

FIG. 10 is a partially cutaway plan view of the drive mechanism;

FIG. 11 is a partially cutaway front view showing a staple bending mechanism;

FIG. 12 is an enlarged perspective view showing the staple bending mechanism;

FIGS. 13(*a*), 13(*b*), 13(*c*) and 13(*d*) are schematic views each showing the bending condition of staples; and FIG. 14 is an electric circuit diagram.

Figure 1:
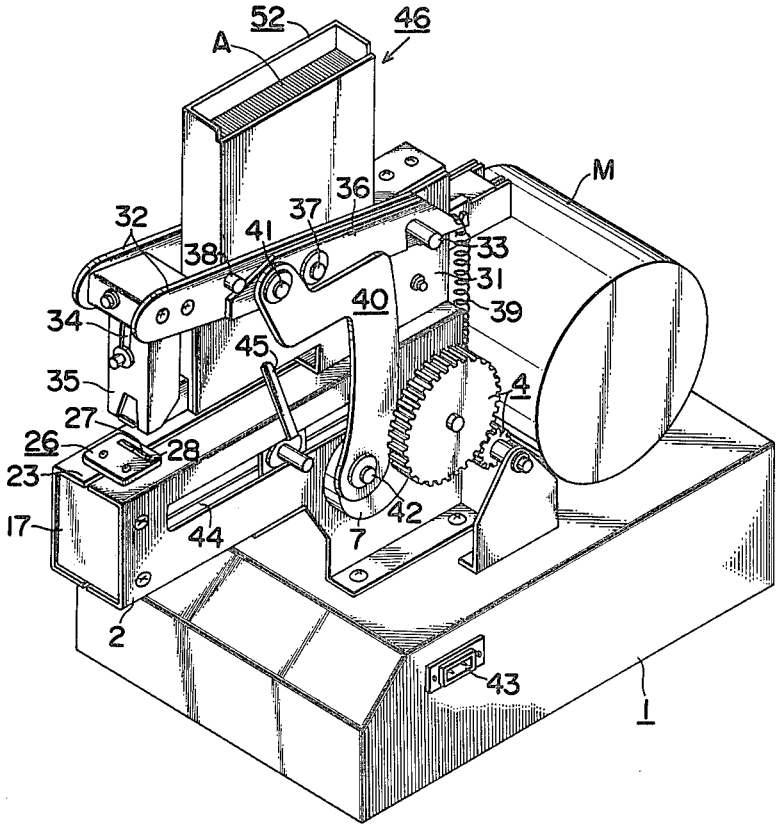
FIG. 1 is a perspective view showing the appearance of the electric stapler of the present invention.

Referring to FIGS. 1 through 3 and 10 through 12, reference numeral 1, shown in FIG. 1, represents a base which is formed in substantially box-like shape and an arm base 2 of a square rod-like shape is secured at the front part on the upper surface of this base 1. A motor M is disposed at the back of this base 1. A drive shaft 3 is rotatably supported at the rear part of the arm base 2 and is driven for rotation by the motor M via a gear interlocking mechanism 4. A drive gear 5 is secured to the drive shaft 3 inside the arm base 2 and an operation rod 6 is formed protrusively on one side surface of this drive gear 5 at an eccentric position. A disc 7 is secured to each end of the drive shaft 3 outside the arm base 2.

A support frame 8 is secured at the front part inside the arm base 2 and fitting plates 9 and 10 are bent-formed at the front and back of this support frame 8. The fore part of an operation plate 11 is mounted to the forward fitting plate 9 and is allowed to rotate by means of a support shaft 12. An operation section 13 is formed at the front end portion of this operation plate 11 and a tapered engaging edge 14 is formed on the upper surface at the rear end portion of the operation plate 11. When the abovementioned drive gear 5 rotates, the operation rod 6 of the drive gear 5 engages with this engaging edge 14 and thus causes the operation plate 11 to rock with the support shaft 12 being as its support point. A stopper 15 of the operation plate 11 is formed protrusively on the rear fitting plate 10 and a coil spring 16 is interposed between the operation plate 11 and the rear fitting plate 10 so as to constantly urge the rear end portion of the operation plate 11 in the upward direction.

A shutter plate 17 is fitted to the front surface of the arm base 2 and a staple flatting plate 19 is fitted movably in the vertical direction inside the shutter plate 17 via a guide plate 18. The staple flatting plate 19 is formed in a substantially L-shaped form and its horizontal plate 20 at the lower end portion is engaged with the lower surface plate of the arm base 2. An elongated guide groove 22 is formed in the vertical direction at the intermediate part of a vertical plate 21 of the staple flatting plate 19 as shown in FIG. 11 and the operation/-section 13 of the operation plate 11 is inserted into this groove 22. An engaging stepped section 24 is defined in the proximity of the upper end of this vertical plate 21 so as to engage with the lower surface of an upper surface plate 23 of the arm base 2. A horizontal press surface 25 is formed at the upper end of the vertical plate 21.

Reference numeral 26 represents a staple bending table which is formed by a relatively rigid material into a substantially rectangular shape and a transversely elongated staple bending groove 27 is formed at the center of the bending table. Inclined guide surfaces 28 are formed on both sides in the longitudinal direction of the groove 27 and extend slantly and inwardly from the upper end portion towards the lower end portion, and an elongated guide groove 29 is bored on the bottom between these guide surfaces 28 to penetrate therethrough and guide the above-mentioned press surface 25. The staple bending table 26 is secured at the front end portion of the upper surface plate 23 of the case 2 and the elongated guide groove 29 of the staple bending table 26 is secured in conformity with an elongated groove 30 which has the same shape as the groove 29 and is formed on the upper surface plate 23 of the arm base 2 in the vertical direction to penetrate therethrough. When the engaging edge 14 of the operation plate 11 is pressed down, the press surface 25 of the staple flatting plate 19 elevates inside these elongated grooves 29 and 30 against resiliency of the coil spring 16.

The press surface 25 closes normally the elongated guide groove 29 of the staple bending table 26 and functions as a pressure-receiving surface when the staple is pressed and bent.

Reference numeral 31 designates a support frame which accommodates therein a staple feeder device to be described later and is secured at the rear part of the arm base 2. The rear end portions of a pair of right and left main arms 32 are turnably pivoted at both rear ends of the support frame 31 via a support shaft 33. A staple push-out blade 34 and an elevating frame 35 are disposed at the front part of these arms 32, said push-out blade 34 capable of sliding detachably with respect to the staple bending table 26. The portion of a sub-arm 36 considerably more forward relative to its intermediate position is turnably connected to the substantially central position of the main arms 32 via a connection shaft 37 and the rear and front parts of this sub-arm abut on the support shaft 33 and on a stopper pin 38 formed protrusively on the main arms 32, thereby restricting the rotation in the clockwise direction. The sub-arm 36 is constantly urged downward by a spring 39 stretched between the rear part of the sub-arm 36 and the arm base 2. The upper end of a crank arm 40 is pivoted to the front end of the sub-arm 36 via a shaft 41 while its lower end is pivoted at an eccentric position of the aforementioned disc 7 via a shaft 42. Reference numeral 43 represents a bayonet socket, 44 does a guide groove formed on one side surface of the arm base 2 and 45 does a lever of a switch $SW_1$ capable of moving back and forth along this guide groove 44.

Figure 4:
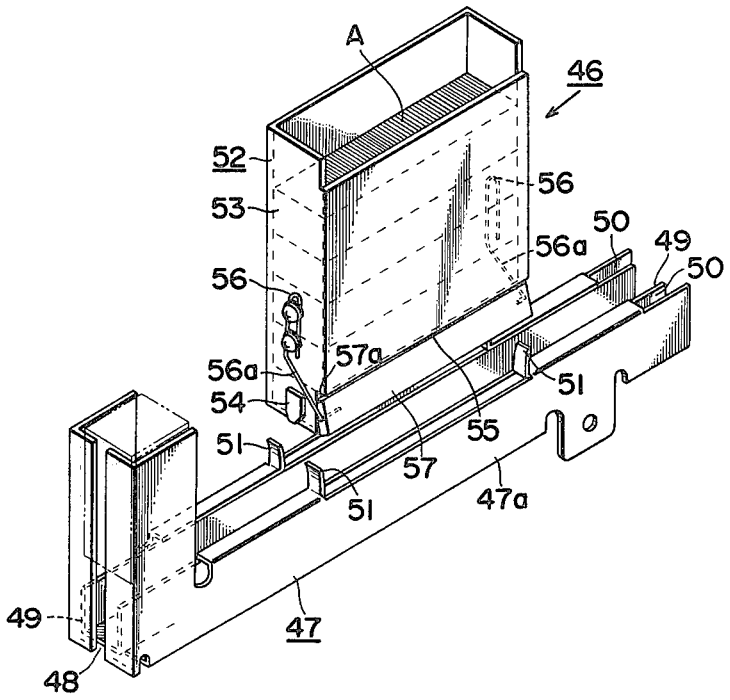
FIG. 4 is a perspective view showing a cassette case loading portion of a staple feeder device for the electric stapler.
Figure 5:
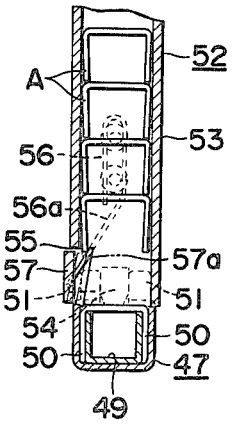
FIG. 5 is a transverse sectional view of the device of FIG. 4.

Reference 46 designates a staple feeder device, which will be explained in further detail with reference to FIGS. 4 through 7. Referring initially to FIGS. 4 and 5, reference numeral 47 designates a staple accommodation cylinder incorporated inside the aforementioned support frame 31 and a staple discharge groove 48 is defined on the front bottom surface of the horizontal cylinder section 47*a* of this staple accommodation cylinder 47. U-shaped guide frame 49 is inserted into the horizontal cylinder section 47*a* and defines a staple guide passage 50 between it and the staple accommodation cylinder 47. Four engaging plates 51 are formed by cutting up the upper surface wall of this horizontal cylinder section 47*a* at a right angle and a cassette case 52 incorporating therein a number of series of staples A in the laminate in the vertical direction is detachably fitted to these engaging plates 51.

The cassette case 52 consists of a case body 53 made of a transparent material, for example, and having both of its top and bottom open. Engaging protuberances 54 are formed at the lower portion on both of its front and rear surfaces to be inserted between and to mate with the abovementioned engaging plates 51, and an opening 55 is formed at the lower end of one side surface so as to face with a shutter plate 57 that is movably supported by spring rods 56 disposed respectively on the front and rear surface of the case body 53. The upper edge 57*a* of this shutter plate 57 protrudes slightly into the case body 53 and prevents fall of the series of staples A.

Since an inclined section 56*a* is formed at the intermediate portion of the spring rod 56, when the cassette case 52 is inserted into the support frame 47, the inclined section 56*a* is caused to deform outwardly by the upper end of the engaging plate 51 and the shutter plate 57 moves from the condition indicated by chain line to the condition indicated by full line in FIG. 5, thereby bringing its inner surface in parallel with the inner surface of the case body 53. Accordingly, the series of staples A accommodated in the case body 53 are caused to drop down into the staple guide passage 25.

Figure 6:
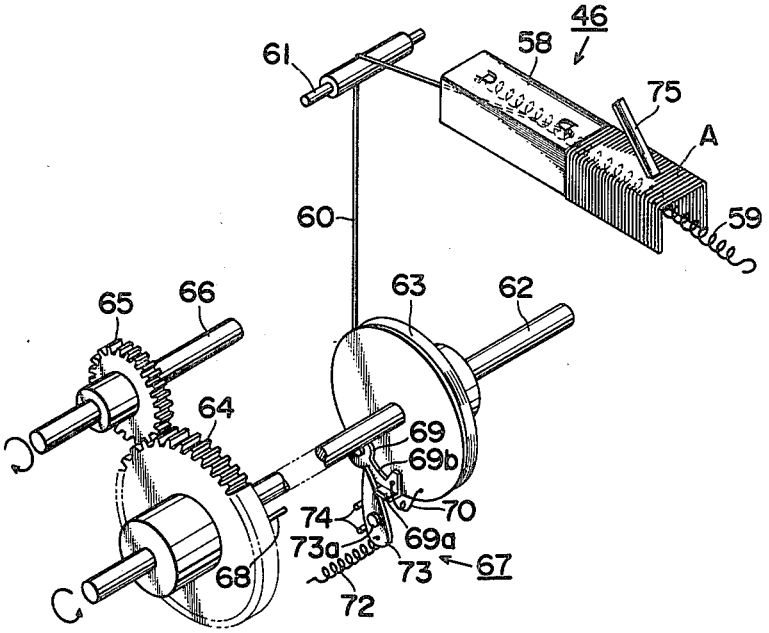
FIG. 6 is a perspective view showing an actuation mechanism of the device of FIG. 4.
Figure 7:
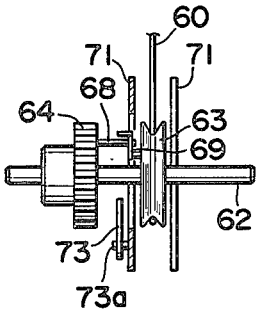
FIG. 7 is a front view showing a partially cutaway clutch mechanism.

Referring now to FIGS. 6 and 7, reference numeral 58 represents a staple press member which is movably inserted into the staple guide passage 50 and is constantly urged forwardly by a spring 59 that is stretched between the front end of the support frame 47 and this staple press member 58. One end of a wire 60 is secured to the staple press member 58 while the other is wound onto and secured to a wire take-up wheel 63 which is turnably supported by a rotary shaft 62 via an intermediate roller 61 and which functions as a clutch plate. A gear 64 is coaxially secured to a rotary shaft 62 that supports turnably the abovementioned wire take-up wheel 63, and engages with another gear 65 which is inturn secured to a drive shaft 66 driven for rotation by the aforementioned motor M. Rotation of the rotary shaft 62, which is disposed in the interlocking arrangement with the drive shaft 66, is transmitted to the abovementioned wire take-up wheel 63 via a clutch mechanism 67. The clutch mechanism 67 consists of a clutch pin 68 formed protrusively from one side surface of the gear 64; a clutch pawl 69 having one of its ends pivoted to the wire take-up wheel 63 and including a rightangled clutch plate 69*a* formed at the outside thereof and a notch 69*b* formed thereinside so as to engage with the clutch pin 68; a toggle spring 70 of which both ends are secured to the other end of the clutch pawl 69 and to the wire take-up wheel 63, respectively; and a clutch switch pawl 73 supported onto a side plate 71 by means of a shaft 73*a* and having its tip restricted by a spring 72 so as to advance into the orbit of revolution of the clutch pawl 69. Reference numeral 74 represents stopper pins which restrict the stationary position of the clutch switch pawl 73 and reference numeral 75 represents a staple return-prevention pawl.

In FIG. 9, reference numeral 78 represents a support table that is detachably fitted to the arm base 2 and this support table 78 will be explained in further detail with reference to FIG. 9. A guide hole 79 is defined at the center on the support table 78 to thereby expose the staple bending table 26 and stopper plates 81 each having a slide groove 80 are formed on both sides of the guide hole 79 and are allowed to move back and forth. Switches $SW_2$ and $SW_3$ are disposed inside these slide grooves 80 of the stopper plates 81, respectively, and are allowed to move to the right and left. A plug 82 is wired to each switch $SW_2$, $SW_3$for the electric connection to the aforementioned bayonet socket 43.

The electric circuit of the abovementioned device will now be explained by referring to the circuit diagram shown in FIG. 14, wherein reference symbols a and b represent power source terminals. Between these power source terminals a and b are sequentially interposed a resistor $R_1$, a diode D, a parallel circuit of the switches $SW_1$, $SW_2$ and $SW_3$, a parallel circuit of a capacitor $C_2$ and a resistor $R_2$ and a first relay $Ry_1$ in order named. A capacitor $C_1$ is interposed between the diode D and the power terminal b, and a parallel circuit of the relay contact $RS_1$ of the first relay $Ry_1$ and a switch KS, which is opened or closed by a self-retaining cam K driven for rotation by the motor M, and a second relay $Ry_2$ are sequentially interposed in series between both ends of the capacitor $C_1$. Between both power terminals a and b are wired sequentially in series the motor M and the relay contact $RS_2$ of the second relay $Ry_2$.

Next, the explanation will be given on the action of the electric stapler in accordance with the present invention.

When leaves of paper to be bound B are first inserted between the staple bending table 26 and the elevating frame 35, their tip causes the switch lever 45 to turn whereby the switch $SW_1$ interlocking with the switch lever is closed and the first relay $Ry_1$ is energized over a predetermined period which is determined by the time constant between the resistor $R_2$ and the capacitor $C_2$. The time of this energized state is set within a period during which the self-retaining cam K turns one round. When the first relay $Ry_1$ is energized, its relay contact $RS_1$ is closed and the second relay $Ry_2$ is turned on, thereby closing its relay contact $RS_2$ and thus actuating the motor M. Actuation of the motor M in turn rotates the self-retaining cam K so that the switch KS, which has fallen into the bottom of the cam K and has been opened, is now close. Hence, even after the relay contact $RS_1$ is open, rotation of the motor M continues till the switch KS again falls into the bottom of the cam K and is open after its one turn. In other words, if one whole action is set so as to correspond to one turn of the self-retaining cam K, the motor M is allowed to automatically stop its revolution after completion of the action.

Revolution of the motor M drives the driving shaft 3 via the gear interlocking mechanism 4 and the drive wheel 5 interlocking therewith and the discs 7 secured to both ends of this drive shaft 3 make substantially one turn. Along with rotation of this disc 7, the crank arm 40 pivoted to its eccentric position starts lowering whereby a force acts downwardly on the front end portion of the subarm 36 of which rear end portion is urged downwardly by the spring 39. Consequently, the sub-arm 36 rotates counterclockwise against the spring 39 and at the same time, the main arm 32 connected to the sub-arm by means of the connection shaft 37 also rotates counter-clockwise with the support shaft 33 being as its support point. In this manner, the front end portion of the main arm 32 is caused to lower, and the elevating frame 35 as well as the staple push-out blade 34 of the main arm 32 are also caused to lower. As the elevating frame 35 is pressed onto the leaves of paper B to be bound that are placed on the staple bending table 26, the staple push-out blade 34 further pushes out the foremost staple A inside the staple accommodation cylinder 47 from the staple discharge groove 48, and causes the staple to penetrate through the leaves of paper B whereby both legs $A_1$ of the staple A are bent inwardly by the staple bending table 26, thus carrying out the binding operation.

In other words, when both legs $A_1$ of the staple A penetrate through the leaves of paper B to be bound and their lower ends strike the inclined guide surfaces 28 in the staple bending groove 27 of the staple bending table 26 as depicted in FIG. 13*a*, they are bent gradually and inwardly along the inclined guide surface 28 as shown in FIG. 13*b*. The lower portion of each leg $A_1$ is bent further inwardly and upwardly with the press surface 25 being as its pressure receiving surface, said press surface 25 of the staple flatting plate 19 facing the elongated guide groove 29 on the bottom of the staple bending table 26. Finally, each leg $A_1$ is bent to form a curved section $A_2$ protruding outwardly in a substantially arc-shape and binds the leaves of paper B to be bound.

Figure 2:
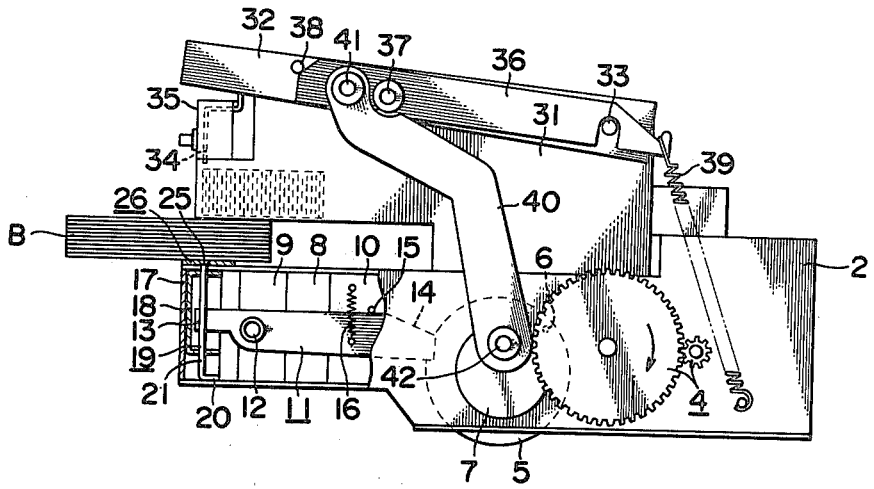
FIGS. 2 and 3 are partially cutaway side views each showing a different operating condition of a drive mechanism for the electric stapler.
Figure 3:
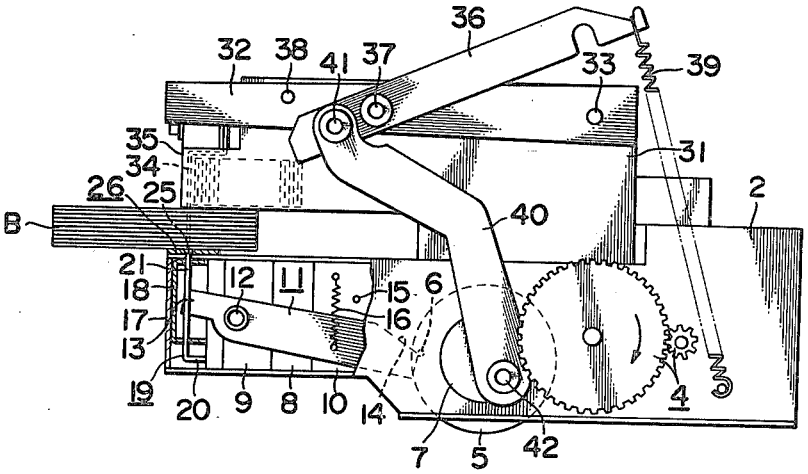

When the lower end portion of the crank arm 40 changes from the state shown in FIG. 2 to the position shown in FIG. 3 and when the staple A is bent and deformed from the state shown in FIG. 13(*a*) to the state shown in FIG.13(*c*) and thus finishes the binding operation of the leaves of paper B to be bound, the operation rod 6 of the drive wheel 5 secured to the drive shaft 3 substantially synchronously pushes down the engaging edge 14 at the rear portion of the operation plate 11 along with revolution of the drive shaft 3, whereupon the operation plate 11 is caused to turn clockwise in FIG. 3 with the support shaft 12 being as its support point against the resiliency of the coil spring 16 and pushes up the staple flatting plate 19 by means of the operation section 13 at the front part of the operation plate 11. Since the press surface 25 at the upper end section of this staple flatting plate 19 is pushed up consequently via the elongated guide grooves 29 and 30, the press surface 25 presses the curved sections $A_2$ of the staple A, which are formed after binding of the leaves of paper B, deforms and corrects the curved sections $A_2$ into flat shape sections $A_3$ and fasten the lower surface of the bound paper B by means of these flat shape sections $A_3$. In this case, the upper side of the staple A is pressed and supported by the staple push-out blade 34.

Accordingly, the flat shape section $A_3$ is either formed along the lower surface of the bound paper B or partially embedded into the lower surface of the bound paper and fastened there, and is thus prevented from protruding outward.

When the drive shaft 3 is further driven to thereby turn eccentrically the crank arm 40 further, the main arm 32 returns to rotate in the clockwise direction and the sub-arm 36 also is returned to rotate clockwise due to righting moment of the coil spring 39, thereby releasing the gap between the staple bending table 26, the staple push-out blade 34 and the elevating frame 35, and preparing for the subsequent binding operation of the leaves of paper B to be bound.

Next, the explanation will be given on the case where the thickness of the leaves of paper B to be bound exceeds a predetermined thickness. In such a case, when the elevating frame 35 at the tip of the main arm 32 abuts on the upper surface of the leaves of paper B to be bound due to rotation of the main arm 32, the staple push-out blade 34 descends further and carries out the binding work till it can no longer descend to exceed the thickness of the leaves of paper B to be bound. However, the crank arm 40 attempts to further descend due to rotation of the disc 7. In this case, instead of movement of the main arm 32, the sub-arm 36 rotates counter-clockwise with the connection shaft 37 being as its support point against the tensile force of the spring 39 as shown in FIG. 3. In other words, since the main arm 32 is allowed to escape by means of the spring 39, no excessive force is applied to the main arm, thereby preventing mechanical damages. This means that once a predetermined load is applied to the tip of the main arm 32, no force exceeding the load is permitted to act on the main arm. That is to say, the binding work can be effected constantly with a predetermined push force irrespective of the thickness of the leaves of paper B to be bound.

Next, the action of the staple feeder device 46 will be explained. Now, when a series of the staples A located inside the staple guide passage 50 is pushed out perfectly forwardly from the lower surface of the cassette case 52 by the staple press member 58, the outer end of the clutch plate 69*a* of the clutch pawl 69 strikes the clutch switch pawl 73 as shown in FIG. 8(*a*) whereby the clutch pawl 69 displaces inwardly due to the toggle action of the toggle spring 70 and its notch section 69*b* engages with the clutch pin 68. Since this clutch pin 68 turns counter-clockwise in the interlocking arrangement with the revolution of the motor M, the wire take-up wheel 63 is driven for rotation in the counter-clockwise direction via the engagement with the clutch pawl 69 as shown in FIG. 8(*b*), takes up its wire 60 and pulls back the staple press member 58 against the spring 59. When the wire take-up wheel 63 turns by about 320° as shown in FIG.8(*c*), the front end portion of the staple press member 58 falls off perfectly from the lower surface of the cassette case so that the lowermost series of staples inside the cassette case 52 falls down and is accommodated inside the staple guide passage 50. Thereafter, since the inner end of the clutch plate 69*a* of the clutch pawl 69 strikes the clutch switch pawl 73, the clutch pawl 69 displaces outwardly due to the action of the toggle spring 70, whereby engagement between the clutch pawl 69 and the clutch pin 68 is released and rotation from the clutch pin is no longer transmitted to the wire take-up wheel 63. In consequence, the staple press member 58 is urged forwardly by the spring 59 and pushes and urges forwardly the series of staples A inside the staple guide passage 50. In this manner, the series of staples A are automatically supplemented and continuously supplied.

Incidentally, in the cassette case in this embodiment, since the upper end portion of the shutter plate 57 protrudes at an angle into the case before loading of the case into the support frame 47, the protrusive edge 57*a* restricts the lower end portion of the series of staples A and prevent their fall. However, when the cassette case is loaded into the staple feeder device, the engaging plate 51 displaces outward the spring rod 56 and moves the shutter plate 57 outwardly so that the protrusive edge 57*a* of the shutter plate 57 moves outwardly and a series of the staples A accommodated in the cassette case 52 is allowed to automatically fall down into the staple guide passage 50.

It is possible to perform the binding work at two positions by securing the support table 78 at a suitable position of the arm base 2 in accordance with a desired application. In this case, the depth of the binding position is determined by moving back and forth the stopper plate 81 on the support table 78, and the right and left positions are determined by moving to the right and left the positions of the respective switches $SW_2$ and $SW_3$ along the slide grooves 80. The binding work in this case is carried out by moving the tip of the leaves of paper B to be bound to the right or left while the tip is being abutted against the stopper plate 81 so as to close the respective switches $SW_2$ and $SW_3$ in the same way as mentioned already.

The device of the present invention can perform the binding work of a bag when this support table 78 is not used, because it only employs the arm base 2.

According to the present invention, the main arm for elevating the staple push-out blade with respect to the staple bending table is interconnected to the sub-arm having one end connected to the driving mechanism and the other end connected to the spring so that when a load exceeding a predetermined level is applied to the main arm, the force of rotation from the drive mechanism rotates the sub-arm against the spring, and the sub-arm absorbs the load exceeding a predetermined level and prevents the excessive mechanical force from acting on the main arm. Accordingly, even when the thickness of the leaves of paper B to be bound is great, the binding work can be made always smoothly without being affected adversely by the thickness and without causing mechanical troubles.

In accordance with the present invention, further, the inclined guide surfaces are defined on both sides of the staple bending table so as to inwardly guide both legs of the staple, the elongated guide grooves is formed on the bottom between these inclined surfaces to penetrate therethrough vertically and the press surface of the staple flatting plate is disposed elevatably inside this elongated guide groove so that when the staple is pushed into the leaves of paper to be bound, both legs of the staple are curved on the inclined guide surfaces inwardly, respectively, and the curved sections are easily corrected into a flat shape when the press surface of the staple flatting plate is pressed to the curved sections. Consequently, both legs of the staple after binding are shaped along the bottom surface of the bound paper and are prevented from protruding remarkably outwardly. Hence, the paper after binding can be handled and put in order easily and when the paper are laminated, the portion of the staple does not become bulky in comparison with the rest such as in the case of the conventional staple. Hence, the legs of staple neither cause injury nor scratch other leaves of paper.

In accordance with the present invention, there is provided an electric stapler equipped with the clutch mechanism in which the clutch plate is rotated unidirectionally along with unidirectional movement of the staple press member inside the staple guide passage and the angle of rotation of the clutch plate transmits the force of rotation in a predetermined angle to the clutch plate in the other direction. Accordingly, when the staple press member pushes forward the staple inside the staple guide passage to the forward position, the press mechanism is caused to automatically move backward by the action of the clutch mechanism and that of the clutch plate with the consequence that during this time a series of staples falls down into the guide passage from the cassette case thereabove, thereby feeding automatically the staple. Moreover, since the cassette case is capable of accommodating a plurality of series of staples in the piled state, it is possible to automatically feed the staples. Loading of the staple can be made easily and accurately while the cassette case is removed from the device, thus improving markedly the operation efficiency.

According to the present invention, there is provided an electric stapler having excellent operation efficiency which enables to continuously feed the staples to the binding section, to perform the binding work constantly accurately using the staples while sufficiently corresponding to the thickness of the leaves of paper to be bound and to flatten both curved legs of the staple simultaneously with the binding action.

What is claimed is:

1. A stapler comprising:

a staple bending table having inclined guide surfaces for guiding and bending both legs of a staple;

a main arm having a staple push-out blade at the forward edge thereof and pivotably supported at a support point at the rear edge thereof;

said staple push-out blade being movable in an approaching direction toward and in departing direction away from said staple bending table;

means for supporting said main arm relative to said table;

a sub-arm pivotably supported by said main arm at a position other than the said support point of said main arm;

a drive mechanism rotatably connected to said sub-arm at a position more forward with respect to said support point of said sub-arm and adapted to impart a rotary force in one direction to said sub-arm; and a spring secured to said sub-arm at a position more rearward with respect to said support point of said sub-arm and adapted to impart a rotary force to said sub-arm in a direction opposite to said one direction.

2. A stapler comprising:

a staple bending table having inclined guide surfaces for guiding and bending inwardly both legs of a staple;

an arm having a staple push-out blade at the forward edge thereof and pivotably supported at a support point at the rear edge thereof;

said staple push-out blade being movable in an approaching direction toward and in a departing direction away from said staple bending table;

means for supporting said arm relative to said table;

a drive mechanism rotatably connected to said arm at a position more forward with respect to, and other than, said support point for rotation of said arm and adapted to impart a rotary force in one direction to said arm;

a staple guide passage defined inside said arm for supplying staples to said staple push-out blade;

a cassette case fitted detachably into said staple guide passage and incorporating therein a plurality of staples to be supplied into said staple guide passage;

a staple press member disposed movably inside said staple guide passage and movable in one direction for pushing the staples supplied from said cassette case into said staple guide passage toward said staple push-out blade;

a clutch plate rotating in one direction along with movement in said one direction of said staple press member and adapted to move said staple press member in a direction opposite to said one direction in response to rotation of said clutch plate in the opposite direction; and a clutch mechanism for transmitting a rotary force to said clutch plate in said opposite direction in accordance with a predetermined angle of rotation of said clutch plate in its said one direction.

3. A stapler for binding leaves of paper comprising:

a staple bending table having inclined guide surfaces on both sides thereof for guiding and bending inwardly both legs of a staple and an elongated guide groove defined on the bottom of said table between said inclined guide surfaces and extending therethrough in the vertical direction;

a main arm having a staple push-out blade at the forward edge thereof and pivotably supported at a support point at the rear edge thereof;

means for supporting said main arm relative to said table;

said staple push-out blade being movable in an approaching direction toward and in a departing direction away from said staple bending table to thereby bind leaves of paper;

a sub-arm for rotating said main arm pivotably connected to said main arm at a position more forward with respect to, and other than, said support point so as to enable said sub-arm to normally rotate together with said main arm and further enable said sub-arm to rotate independently of said main arm when a force exceeding a predetermined level is imparted to move said main arm;

a staple flatting plate disposed elevatably inside said elongated guide groove of said staple bending table, said plate having an upper end portion for pressing and flattening both legs of a staple which has been pushed to penetrate through leaves of paper and curved by said inclined guide surfaces of said staple bending table;

a cassette case fitted detachably into said main arm and incorporating therein a plurality of staples to be supplied to said staple push-out blade; and supply means for supplying sequentially the staples inside said cassette case to said staple push-out blade.

* * * * *